US010864528B2

(12) United States Patent
Filmer et al.

(10) Patent No.: US 10,864,528 B2
(45) Date of Patent: Dec. 15, 2020

(54) REDUCING THE NEED FOR TAILINGS STORAGE DAMS IN THE IRON ORE INDUSTRY

(71) Applicant: ANGLO AMERICAN SERVICES (UK) LTD, London (GB)

(72) Inventors: Anthony Owen Filmer, Kangaroo Point (AU); Daniel John Alexander, London (GB)

(73) Assignee: ANGLO AMERICAN SERVICES (UK) LTD., London (GB)

( * ) Notice: Subject to any disclaimer, the term of this patent is extended or adjusted under 35 U.S.C. 154(b) by 362 days.

(21) Appl. No.: 15/843,850

(22) Filed: Dec. 15, 2017

(65) Prior Publication Data

US 2018/0111131 A1 Apr. 26, 2018

Related U.S. Application Data

(63) Continuation-in-part of application No. 15/299,955, filed on Oct. 21, 2016.

(Continued)

(51) Int. Cl.

| | |
|---|---|
| ***B03D 1/08*** | (2006.01) |
| ***B03D 1/10*** | (2006.01) |
| ***B02C 23/12*** | (2006.01) |
| ***B03C 1/00*** | (2006.01) |
| ***B03C 1/30*** | (2006.01) |

(Continued)

(52) U.S. Cl.

CPC ..... *B03D 1/087* (2013.01); *B02C 23/12* (2013.01); *B03B 7/00* (2013.01); *B03C 1/002* (2013.01); *B03C 1/30* (2013.01); *B03D 1/02* (2013.01); *B03D 1/10* (2013.01); *B03D 2203/04* (2013.01)

(58) Field of Classification Search

CPC ..... B03D 1/087; B03D 1/10; B03D 2203/04; B03C 1/30; B03C 1/002; B03B 7/00; B02C 23/12

See application file for complete search history.

(56) References Cited

U.S. PATENT DOCUMENTS 3,337,328 A 8/1967 Lawver
3,502,271 A * 3/1970 Hays ..... B03D 1/02 241/20

(Continued)

FOREIGN PATENT DOCUMENTS

WO WO-2016-170437 A1 10/2016

OTHER PUBLICATIONS

Australian Office Action for 2017276325, dated Oct. 25, 2019.

*Primary Examiner* — Jonathan G Riley
(74) *Attorney, Agent, or Firm* — Nixon Peabody LLP; Jeffrey L. Costellia

(57) ABSTRACT

THIS invention relates to an integrated process for recovering the valuable iron fraction from low grade iron ore, including the steps of: comminution 14 and classification 36/39 to obtain a classified fraction suitable for coarse flotation and classified fraction suitable for fine beneficiation; subjecting the fraction suitable for coarse flotation to coarse flotation 40 to obtain an intermediate iron concentrate 42 and a coarse sand residue 44; grinding the intermediate concentrate to a size suitable for fine beneficiation; and subjecting the fractions suitable for fine beneficiation to fine beneficiation 46 and obtaining a final iron concentrate 48 and a fine tailings 50.

9 Claims, 2 Drawing Sheets

Related U.S. Application Data

(60) Provisional application No. 62/334,557, filed on May 11, 2016.

(51) Int. Cl.
*B03D 1/02* (2006.01)
*B03B 7/00* (2006.01)

(56) References Cited

U.S. PATENT DOCUMENTS 5,338,337 A * 8/1994 Johnson ..... B03B 9/00 209/164
5,900,604 A * 5/1999 McNeill ..... B03B 9/00 209/12.1
6,319,389 B1 * 11/2001 Fountain ..... B03D 1/025 205/583
6,679,383 B2 * 1/2004 Gathje ..... B03D 1/02 209/166
10,207,275 B2 * 2/2019 Donda ..... C22B 1/00
2005/0139551 A1 * 6/2005 Yoon ..... C02F 11/14 210/727
2009/0071295 A1 * 3/2009 Gorain ..... C22B 11/08 75/710
2011/0155651 A1 * 6/2011 Gorain ..... C22B 15/0002 209/162
2012/0152534 A1 * 6/2012 Troshko ..... E21B 43/40 166/268
2012/0289440 A1 * 11/2012 Pollard ..... C10G 1/00 508/110
2013/0032004 A1 * 2/2013 Hilshorst ..... C22B 1/00 75/10.67
2013/0134074 A1 * 5/2013 Soane ..... C02F 1/26 209/162
2016/0090536 A1 * 3/2016 Yuan ..... C10G 1/047 208/390
2016/0310956 A1 * 10/2016 Filmer ..... C22B 13/00

* cited by examiner

REDUCING THE NEED FOR TAILINGS STORAGE DAMS IN THE IRON ORE INDUSTRY

BACKGROUND TO THE INVENTION

Tailings facilities arising from the recovery of low grade iron ore deposits have historically and still continue to create a legacy for the iron ore industry, and for the communities which host these mining and mineral processing operations. The tailings take the form of silt (<75 micron), fine sand (75-150 micron), and some coarser sand (>150 micron). The high silt content causes the tailings to have a very low hydraulic conductivity which means they do not drain freely, and are subject to liquefaction if placed under stress.

For many iron containing resources (e.g. itabirites, taconites and banded ironstones), fine grinding of the ore is required to almost fully liberate the valuable iron ore from the attached gangue. The finely ground ore can then be separated from the gangue to produce a high grade iron ore concentrate suitable for pellet or sinter production. The size range required for sufficient liberation of the itabirite or similar mineral assemblages is usually a p80 of below 150 micron and often below a p80 of 75 micron. Consequently, all the gangue materials associated with the valuable mineral in the iron ore are comminuted to the required size, resulting in large proportions of silt (<75 micron) in the feed to final beneficiation, typically by flotation, or magnetic separation.

As a consequence of this excessive silt content, the tailings arising from the final beneficiation of this finely ground low grade iron ore, are stored in a purpose built tailings storage facility (TSF) constructed at a significant capital cost. The fine tailings also contain water entrained in the fine gangue, which comprises the largest proportion of the net water consumption for the mine.

With reference to FIG. 1, in a conventional fine beneficiation circuit, run of mine (ROM) ore 10 from blasting and crushing 12 is ground 14 and classified 16, typically in a closed circuit with a mill, returning the oversize material 18 from classification for further grinding, to ultimately produce the required liberation size for fine beneficiation 19 to produce a high grade iron concentrate 20 and tailings.

Various techniques are utilised for fine beneficiation to separate the iron containing minerals from the fine gangue; including flotation and wet high intensity magnetic separation (WHIMs). Gravity based techniques are sometimes considered, but if the liberation size is below 150 microns, efficient separation of fine iron containing minerals and fine gangue is difficult.

The residue from fine beneficiation is the tailings material that must be stored in a TSF.

Technologies have been proposed to avoid or minimise the requirement for the TSF to store wet tailings. These include dry processing, and filtration of the wet tailings from flotation or wet magnetic separation. These technologies have not been routinely applied until recently, where some operations are installing expensive tailings filtration systems. This filtration of a high silt content tailings slurry requires large filter areas due to the low hydraulic conductivity of the tailings and consequential slow dewatering.

Coarse beneficiation is also widely used by the iron ore industry, particularly for the higher grade resources, and can take several forms. Typically coarse beneficiation has been applied to iron ores where only modest proportions of gangue need to be removed, and takes place at sizes from around 1 mm up to 100 mm. The iron ore grade is enhanced by techniques such as screening, dense media separation, hydraulic classifiers, and jigs, leaving a finer and lighter waste product still containing significant proportions of locked iron and gangue. This gangue is often at an iron grade which warrants further recovery by grinding and fine beneficiation.

In some cases the coarsely beneficiated iron ore is still not at a saleable grade due to attached gangue, and hence it is further ground and further beneficiated, in a process akin to that described in FIG. 1.

In the lower grade iron ores, whether these occur naturally or arise as residues from coarse beneficiation of high grade iron ore, the iron content is not sufficiently liberated to form a saleable product until it is more finely ground, typically to less than or around 100 micron. At this fine size, the product grade from fine beneficiation is acceptable, but the tailings cannot be readily dewatered.

It is an object of this invention to provide an integrated processing system to treat those lower grade iron ores that require fine grinding to achieve liberation, and fine beneficiation to upgrade the ore to a saleable product, whilst minimising the production of fine tailings.

SUMMARY OF THE INVENTION

THIS invention relates to an integrated process for recovering the valuable iron fraction from low grade iron ore, including the steps of:

a) comminution of the iron ore in a comminution device,
b) classification of the comminuted iron ore to obtain a classified fraction suitable for coarse flotation and classified fraction suitable for fine beneficiation;
c) subjecting the fraction suitable for coarse flotation to coarse flotation to obtain an intermediate iron concentrate and a coarse sand residue;
d) grinding the intermediate concentrate to a size suitable for fine beneficiation; and
e) subjecting the fractions suitable for fine beneficiation to fine beneficiation and obtaining a final iron concentrate and a fine tailings.

The coarse residue and fine tailings are stored separately; or the process may include an additional step, wherein:

f) the coarse sand residue is blended with fine tailings to obtain a blend, and dry stacking the blend thereby to obtain a stacked heap.

The comminution of the ore at step a) may be carried out in closed circuit with classification at step b) arranged such that feed to coarse flotation is in a size range at which at least 40% of the gangue is predominantly liberated, and preferably more than 60% of the gangue and even more preferably more than 75% of the gangue.

At step a) the ore which is directed to coarse flotation may be classified to a particle size range which maximises the coarse gangue rejection from the circuit in step c), at a grade which is less than 20% iron, and preferably less than 15% Fe, and even more preferably less than 10% Fe.

The classified faction suitable for coarse flotation may be within the size range from 75 micron up to 1500 micron, and more preferably within the range from 100 micron to 1000 micron, and even more preferably within the range from 100 micron to 600 micron.

The classified faction suitable for fine beneficiation may have a particle size of less than 75 micron, typically less than 100 micron.

An oversize fraction from step b) may be recycled to comminution step a) for further comminution.

The intermediate concentrate from coarse flotation step c) may be directed to a regrind in step e) and reclassification process, to produce the optimum size distribution for fine flotation, and where the grade of the intermediate concentrate is typically more than 40% Fe, and preferably more than 45% Fe, and even more preferably more than 50% Fe.

The comminution of the ore at step a) may be carried out in closed circuit with classification at step b) arranged such the fraction of silt (with a particle size less than 75 micron) in the gangue content of the feed to fine beneficiation, is less than 65%, and preferably less than 50%, and even more preferably less than 40% by mass.

The coarse sand residue in step c) typically contains less than 10% silt, and preferably less than 5% silt, and is free-draining, typically with a hydraulic conductivity higher than 1 cm/sec.

The dry stacking of the blended materials may take place either by dewatering of both fractions using screens or filters or thickeners and moving blended residue to the dry stack, or by hydraulic stacking of the blended materials and draining the stack to recover the water.

The blend may contain a ratio of 0.5 to 0.8 coarse sand to 0.5 to 0.2 fine tailings, preferably a ratio of 0.5 to 0.7 coarse sand to 0.5 to 0.3 fine tailings, more preferably a ratio of fine tailings of 0.6 coarse sand to 0.4 fine tailings by mass.

Typically, the coarse sand residue is dewatered, and the fine tailings are thickened prior to blending The blend may contain from 10% up to 30% by mass of silt (very fine tailings of less than 75 micron diameter), and from 70% to 90% by mass dewatered residue with a particle size of greater than 75 microns.

The coarse sand residue may be dewatered to less than 20% water by weight, for example about 8 to 12% water by weight, typically to about 10% water by weight.

Water in the thickened fine tailings in may be reduced to 35 to 45% water by weight, typically to about 40% water by weight.

The fine beneficiation may be conventional fine flotation or magnetic separation, preferably conventional fine flotation.

Unit costs of iron ore production may be decreased, through enhancement of one or more of the higher throughput capacity, lower tailings generation, lower water consumption, and improved energy efficiency.

The recovery of the resource may increased, through enhancement of one or more of the higher throughput capacity, lower tailings generation, lower water consumption, and improved energy efficiency.

DETAILED DESCRIPTION

THIS invention utilises a new coarse beneficiation technique which operates in the size range typically between around 1 mm and 0.1 mm, where a significant proportion of the gangue and hematite are at least partially liberated, and hence pre-beneficiation can occur; but the size is not so fine that excessive silt is already present in the residue.

This beneficiation technique, coarse flotation, when integrated with the overall processing system from comminution to residue disposal, can reduce or eliminate the formation of tailings which requires storage in a TSF.

Coarse flotation has not been commercially applied to iron ore, nor have any studies been reported in the literature. The process uses equipment such as the Hydrofloat cell, manufactured by Eriez (U.S. Pat. No. 6,425,485 B1, 2002). The potential for application of this cell for treating phosphate is well established. For copper, gold, and other sulphide ores, it is described extensively (such as J. Concha, E. Wasmund http://docplayer.es/10992550-Flotacion-de-finos-y-gruesos-aplicada-a-la-recuperacion-de-minerales-de-cobre.html.), and is achieving its first commercial sales in the base metals industry. There are also other coarse flotation cell designs, and other related methods have been proposed for separating partially exposed coarse particles from gangue, by selective attachment of a collecting agent and flotation. For simplicity, all these alternative separation technologies, will all be termed coarse flotation.

The low grade iron ore is partially ground in normal comminution equipment such as ball mills operating in closed circuit with classification. The resulting range of sizes in the product of the comminution device, is classified into three size based fractions, each to be processed differently.

Figure 1:
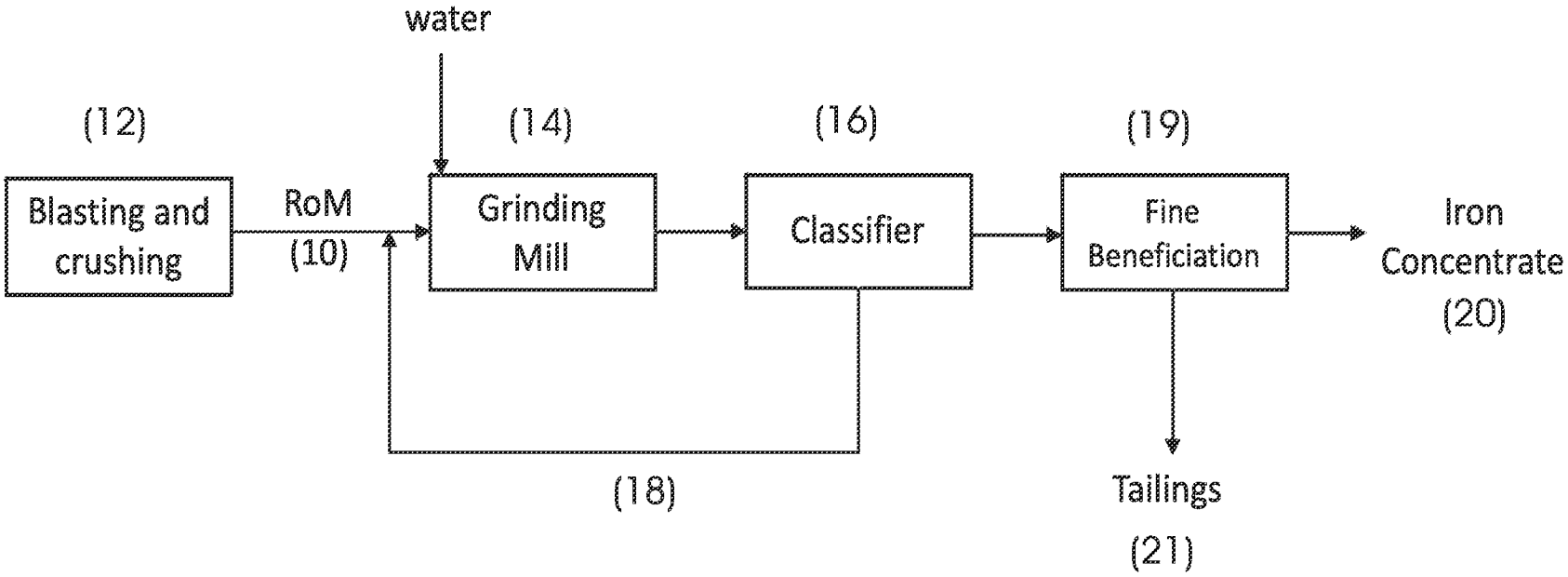
FIG. 1 is a flow diagram of a conventional fine flotation circuit.
Figure 2:
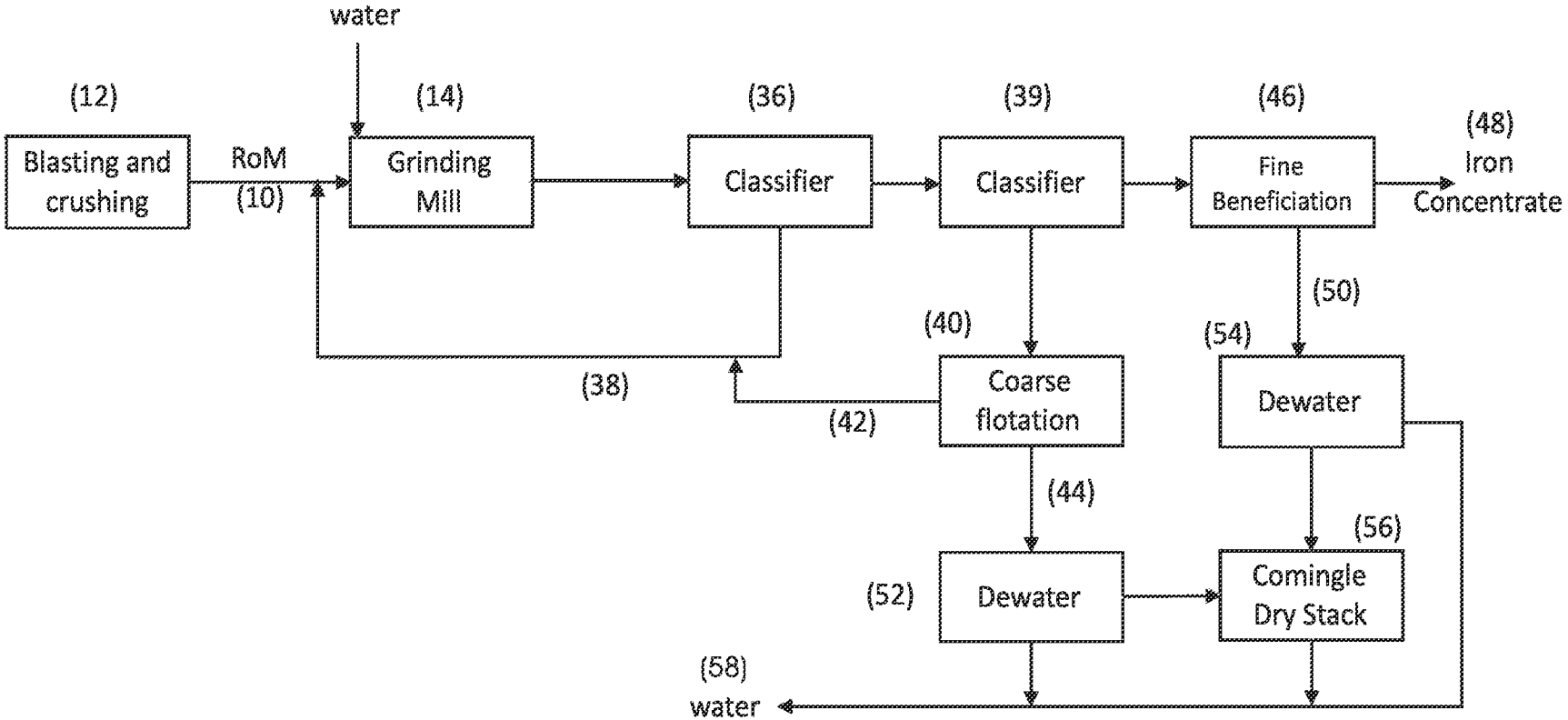
FIG. 2 is a flow diagram of a course flotation circuit according to an embodiment of the invention.

One configuration for this two stage classification is shown in FIG. 2. Other possible configurations of classification and grinding circuit to achieve this objective are well known to those skilled in the art, and include the order in which size classification occurs, the combined or separate regrinding circuits, and operating the comminution equipment in closed or open circuit.

With reference to FIG. 2, run of mine (ROM) ore 10 from blasting and crushing 12 is ground 14 and classified in a first classifier 36. The first classifier 36, operating in a closed circuit with a ball mill, returns the first of the three classification sizes, the oversize material 38, for further grinding. Depending on the specific ore, this oversize material requiring further grinding to liberate sufficient gangue, is typically greater than 0.4 mm and can potentially be up to around 1.5 mm. It has insufficient liberated gangue to justify the free gangue removal by coarse beneficiation. The selected upper size limit for the first classifier will be dependent on the specific ore being treated.

Undersize ore from classifier 36 is further classified in a second classifier 39. A second of the three classification sizes is the fraction of the ore in the size window suited for coarse flotation (typically in the size range greater than 100 micron and less than the selected upper size (material 38). The lower size limit for this classification is set by the efficient operation of the coarse flotation process. The upper size limit is where liberation is insufficient to justify coarse beneficiation.

This coarser fraction from classifier 39 is processed using devices such as coarse flotation cells 40, to separate the coarse liberated silica for disposal, and produce an intermediate iron concentrate 42. The intermediate iron concentrate has some composite particles of gangue and iron, and hence is not of a purity suited for direct sale. But it does have a significantly lower silica content than the feed to coarse flotation. The concentrate typically represents 30-70% by solids weight of the feed to coarse flotation, with the remainder being a sand-like residue 44. The intermediate iron concentrate 42 is returned to the ball mill, along with the oversize from classification 38, and ground further to achieve greater liberation of gangue and iron.

The sand like gangue residue 44 from coarse flotation 40 has most of the contained iron removed, and contains very little silt, and is 'free draining' typically with a hydraulic conductivity higher than 1 cm/sec.

The third and finest fraction of material from the classification (typically well liberated iron ore and well liberated gangue (at <100 micron) is directed to conventional fine beneficiation 46. This fine beneficiation 46, using techniques such as fine flotation or magnetic separation, yields a final iron concentrate product 48 and a fine tailings residue 50.

Residue arising from the coarse beneficiation 44 and a proportion of the tailings from the fine beneficiation can be stored separately with water recovery by normal techniques. Preferably the tailings 50 and sand 44 can be thickened 52 and 54, blended and stacked, or hydraulically stacked and drained. The maximum proportion of fine tailings which is blended is determined by the geotechnical requirements for dewatering and dry stacking.

Water is recovered from the thickener 52 and 54 and the dry stacked heap 56. The water 58 from the thickener, and draining from the residue heap, can be recycled.

The excess fine tailings, if any, is managed by a separate process for storage of fine tailings in a smaller TSF.

According to the invention, there is provided an integrated process for recovering a saleable iron containing concentrate from a low grade iron ore such as an itabirite or taconite or banded ironstone ore, or a residue from traditional coarse beneficiation of iron ore; which requires fine grinding to produce an acceptable product grade.

The integrated process is configured such as to substantively reduce or eliminate the need for a tailings storage facility, including the steps of:

a) comminution of the crushed iron ore in a comminution device to produce much of ore in the required size range for gangue liberation,
b) classification of the comminuted iron ore in size classification devices to obtain a classified fraction suitable for further comminution, a classified fraction suitable for coarse beneficiation, and a classified fraction suitable for fine beneficiation;
c) subjecting the fraction suitable for coarse beneficiation to coarse flotation to separate a coarse gangue residue with a low iron content, and to recover the iron as an intermediate iron concentrate;
d) regrinding the oversize from the initial classification and the intermediate iron concentrate to ultimately produce a size suitable for fine beneficiation required to meet a satisfactory product specification, and;
e) subjecting the fractions suitable for fine beneficiation to fine beneficiation to remove most of the remaining gangue as a fine tailings, and produce a saleable iron concentrate;
f) combining the fine tailings and the coarse gangue residue in the ratio of sand to fine tailings, that allows enhanced dewatering and dry stacking, or hydraulic stacking and draining; and stacking the blended residue such that the heap achieves satisfactory geotechnical stability and is not be subject to future liquefaction.

The comminution of the ore at step a) is typically carried out in closed circuit with the classification devices identified in step b). The classification size and circulating load are selected for any particular ore, to capture the maximum amount of the gangue material in the size range suitable for coarse flotation of liberated gangue to form a free draining gangue residue.

Whilst this size will be specific for each particular iron ore feed, the range is between the minimum size suitable for effective coarse flotation, typically around 0.1 mm, and the maximum size suitable for effective coarse flotation, typically around 0.4 mm for poorly liberated ores, and up to 1.5 mm for well liberated ores.

This early rejection of liberated gangue by coarse flotation minimises the subsequent fine gangue production during comminution, and hence the total amount of gangue reporting to the fine tailings. In particular, the coarse flotation avoids the consequential formation of excessive silt (material with a particle size of less than 75 micron diameter) which greatly inhibits the hydraulic conductivity.

While the coarse flotation may operate at a size where some of the gangue is not yet fully liberated from the iron ore, the flotation equipment and process set-points can be selected to direct most of the predominantly iron containing composite particles to the intermediate concentrate. This ensures they are reground to achieve a high degree of liberation prior to fine beneficiation.

If on adjusting the coarse flotation conditions, the gangue fraction still contains excessive iron, the introduction of a scavenger stage such as wet high intensity magnetic separation can be considered. The residue is suitably sized for wet high intensity magnetic separation, and is free of large quantities of fines, thus expediting the separation of composite magnetic particles containing mostly iron, from the predominantly gangue residue. The magnetic fraction can then recycled to grinding to further liberate the gangue.

After further grinding, the iron intermediate concentrate, still containing some liberated iron ore, and some liberated and some attached gangue, recirculates through classification and it again reports to one of the three size fractions. From classification it is directed back to the comminution device, or into another 'bite' for coarse flotation, or forward to conventional fine beneficiation. This closed circuit configuration enables rejection of the maximum quantity of a gangue, without excessive losses of iron ore, and without fine grinding all the gangue to the size required for conventional fine beneficiation.

In classification, the entrainment of fine iron in the fraction of the feed to coarse flotation is minimised, to prevent entrainment losses of this fine iron with the coarse gangue during coarse flotation. This classification may require a combination of two classification devices to produce a steep size partition curve. The classification devices are typically selected from cyclones, screens and hydraulic classifiers.

Examples

For a particular banded ironstone resource located in South Africa, the feed to coarse flotation was simulated, for the purposes of demonstrating the core components of the integrated process. The feed grade to coarse flotation contained 41% iron, with the gangue component being mostly silica (35%), with small quantities of alumina (3%) and other impurities. The simulated coarse flotation feed was formed by separating undersize particles (size less than 100 micron) from a typically ground sample of the ore, using a screen to simulate a cyclone and crossflow hydraulic classifier in series. The upper size fraction for coarse flotation simulating the material to be returned to comminution was screened at 450 micron. With such cut sizes, the fine fraction (<100 microns), would typically represent around 50% of the classified material to be beneficiated.

The undersize (<100 micron) was deemed suitable for fine beneficiation (step e), with more than 90% of the contained hematite being almost fully liberated, and hence suitable to produce a saleable iron ore concentrate.

The classified banded ironstone ore (100-450 microns) was subjected to coarse flotation at step c). The ore feed had a composition of 41% iron and 35% silica, and the coarse flotation produced a sand residue containing mainly gangue and 17% iron. The silt content of this sand residue was less than 1%. The intermediate concentrate formed by coarse flotation contained 51% Fe and 22% silica. This represented a 55% rejection by coarse flotation of gangue to a sand residue, in this single pass through coarse flotation.

A similar test was carried out in which the ground ore feed was classified into two fractions, 100 to 300 microns and 300 to 600 microns. This allowed different teeter rates to be used in the coarse flotation, without increasing entrainment losses of finer iron in the silica product. With the particular operating conditions for this test, recoveries of silica were 30% for the finer fraction, and 40% for the coarser fraction, with iron recoveries being 94% and 83% respectively.

The sand residue from the simulated coarse flotation was thickened to 70% by weight solids, and stacked. The residual heap drained within 5 minutes to around 15% by weight water. The fine tailings from conventional flotation could be thickened but not drained, due to the excessive content of silt.

Whilst these tests of the core of the invention, coarse flotation and dry stacking technologies, were not optimised for different flotation conditions required for this specific ore, they demonstrate that gangue separation and dry stacking is readily achievable.

The recoveries indicate that in a grinding system operating in closed circuit with classification and coarse flotation, (i.e. multiple passes of the gangue through the coarse flotation loop) the rejection of silica as coarse sand would be well above 50%.

Assuming a p80 of 100 micron is appropriate for fine beneficiation, around 50% of the gangue in the tailings from fine beneficiation is likely to be <75 microns. If 60% of the gangue is extracted by coarse flotation, and 40% of the gangue is finely ground to contain 50% silt, the blended coarse and fine residues, would contain around 20% silt. This is well within the industry 'rule of thumb' for producing a free standing heap. With these assumptions, the blending could result in total elimination of a TSF.

The set-points for the comminution, classification and coarse flotation system can be optimised, depending on the objectives for a specific application and ore type; in particular whether the objective is high Fe recovery, or high silica rejection, or avoidance of conventional tailings storage and associated water losses.

In a first embodiment of the current invention, the comminution and classification is designed such that sand residue from coarse beneficiation in step c) significantly exceeds the quantity of fine tailings generated by the fine beneficiation step e). When the two forms of residue are blended they create a mix which can be thickened, hydraulically stacked and drained, or dewatered by screening or filtering prior to stacking. The dewatered residue can all be dry stacked, thus eliminating the need for a TSF.

In a second embodiment, the ratio of sand from coarse flotation to fine beneficiation tailings is lower. Under these circumstances, the blended tailings does not yield a free draining mix. In this case, only some of the fine tailings will be combined with the coarse gangue fraction, and a proportion of the fine tailings will need to be separately stored in a TSF or filtered via known technology. The need for a TSF to store the dewatered residue can be substantively reduced.

In a third embodiment to the invention, the coarse particle flotation feed is further split to a coarse fraction and a fine fraction, allowing split coarse flotation, with conditions to be set to be set appropriately for each size fraction. This can maximise the proportion of silica rejection by scalping through an expanded particle size range. Typically this classification could be 0.1 mm to 0.3 mm, and 0.3 mm up to around 1.0 mm.

In a fourth embodiment to the invention, the coarse flotation is operated to maximise gangue rejection, and the entrained iron contained in the sand residue from coarse flotation is further scavenged by wet high intensity magnetic separation to maximise both iron recovery and coarse silica rejection.

The main benefits of the current invention are to reduce or eliminate the quantity of tailings, and losses of the associated water. In addition to these benefits, the comminution, classification, coarse flotation and tailings management system, that forms the substance of this invention, also enables:

- Reduced energy requirement for the grinding that is required to liberate the iron oxide from gangue
- Higher throughput capacity for given milling and fine flotation equipment sizes
- Increased global iron recovery, arising from less entrainment of fine iron in the fine beneficiation tails
- Potential to economically treat lower grade ores due to reduced costs of grinding and improved tailings management.

The invention claimed is:

1. An integrated process for recovering the valuable iron fraction from low grade iron ore, including the steps of:

a) comminution of the iron ore in a comminution device,
b) classification of the comminuted iron ore to obtain a classified fraction suitable for coarse flotation with a particle size range from 100 micron up to 1000 micron and classified fraction suitable for fine beneficiation with a particle size of less than 100 micron;
c) subjecting the fraction suitable for coarse flotation to coarse flotation to obtain an intermediate iron concentrate and a coarse sand residue with a particle size range from 100 micron up to 1000 micron;
d) grinding the intermediate concentrate to a size suitable for fine beneficiation with a particle size of less than 100 micron; and
e) subjecting the fractions suitable for fine beneficiation from steps b) and d) to fine beneficiation and obtaining a final iron concentrate and a fine tailings; wherein: the coarse sand residue from step c) is dewatered to less than 20 percent water by weight, and the dewatered coarse residue is dry-stacked separately from the fine tailings.

2. The process claimed in claim 1, wherein the comminution of the ore at step a) is carried out in closed circuit with classification at step b) arranged such that feed to coarse flotation is in a size range at which at least 40% of a gangue is predominantly liberated.

3. The process claimed in claim 2, wherein at least 60% of the gangue is predominantly liberated.

4. The process claimed in claim 3, wherein more than 60% of the gangue is predominantly liberated.

5. The process claimed in claim 1, wherein the classified faction suitable for coarse flotation is within the size range from 100 micron to 600 micron.

6. The process claimed in claim 1, wherein an oversize fraction from step b) is recycled to comminution step a).

7. The process claimed in claim 1, wherein the intermediate concentrate from coarse flotation step c) is directed to a regrind in step e).

8. The process claimed in claim 1, wherein the fine beneficiation is fine flotation or magnetic separation.

9. The process claimed in claim 8, wherein the fine beneficiation is fine flotation.

* * * * *